US006615819B1

(12) United States Patent
Hernandez Burgos et al.

(10) Patent No.: US 6,615,819 B1
(45) Date of Patent: Sep. 9, 2003

(54) CONVECTION OVEN

(75) Inventors: Jose Hernandez Burgos, Santiago de Queretaro (MX); Arturo Lona, Santiago de Queretaro (MX)

(73) Assignee: General Electric Company, Louisville, KY (US)

( * ) Notice: Subject to any disclaimer, the term of this patent is extended or adjusted under 35 U.S.C. 154(b) by 0 days.

(21) Appl. No.: 09/523,683

(22) Filed: Mar. 10, 2000

(51) Int. Cl.[7] ..... A21B 1/00
(52) U.S. Cl. ..... 126/21 A; 126/273 R
(58) Field of Search ..... 126/21 A, 19 R, 126/21 R, 273 R, 39 C, 299 R, 299 D; 219/400, 399

(56) References Cited

U.S. PATENT DOCUMENTS 3,109,358 A * 11/1963 Meyer ..... 126/299 D
3,626,922 A 12/1971 Borge
3,656,469 A 4/1972 Jung et al.
3,659,579 A 5/1972 Henderson et al.
4,071,738 A 1/1978 Jenn et al.
4,071,739 A * 1/1978 Jenn et al. ..... 126/21 A
4,109,636 A 8/1978 Burge
4,191,875 A * 3/1980 Cunningham ..... 219/623
4,211,909 A 7/1980 Yoshida et al.
4,278,862 A 7/1981 Mizuno et al.
4,332,992 A 6/1982 Larsen et al.
4,395,233 A 7/1983 Smith et al.
RE31,637 E 7/1984 Yoshida et al.
4,484,561 A 11/1984 Baggott et al.
4,498,453 A 2/1985 Ueda
4,516,012 A 5/1985 Smith et al.
4,535,226 A 8/1985 Logel et al.
4,624,301 A 11/1986 Baggott et al.
4,867,132 A 9/1989 Yencha
4,886,046 A * 12/1989 Welch ..... 126/299 R
5,066,851 A 11/1991 Darvin
5,107,097 A 4/1992 Negandhi et al.
5,111,028 A * 5/1992 Lee ..... 219/413
5,121,737 A 6/1992 Yencha
5,203,315 A 4/1993 Clawson et al.
5,222,474 A 6/1993 Yencha, III
5,235,962 A * 8/1993 Doty et al. ..... 126/21 A
5,336,867 A 8/1994 Miller
5,468,935 A 11/1995 Wang
5,601,070 A 2/1997 Hotard et al.
5,620,623 A 4/1997 Baker
5,756,974 A 5/1998 Hong
5,786,567 A * 7/1998 Wang ..... 126/21 A
5,798,505 A 8/1998 Lee
5,801,362 A 9/1998 Pearlman et al.
5,816,234 A 10/1998 Vasan
6,060,701 A * 5/2000 McKee et al. ..... 126/21 A

FOREIGN PATENT DOCUMENTS

DE 3 117171 A1 * 4/1981 ..... 126/21 A

* cited by examiner

*Primary Examiner*—Henry Bennett
*Assistant Examiner*—Josiah C. Cocks
(74) *Attorney, Agent, or Firm*—H. Neil Houser; Enrique J. Mora; Beusse, Brownlee, Bowdoin & Wolter, PA

(57) ABSTRACT

A convection, oven having a multi-speed fan for circulating hot air within the cooking chamber at a plurality of velocities, with the selection of the appropriate fan speed depending upon the food being cooked in the oven. The fan is disposed within a recess formed in a rear wall of the cooking chamber and is separated from the cooking chamber by a fan cover plate. The cover plate has an inlet opening proximate its center and three elliptical outlet openings equidistantly disposed around its. perimeter. The edge of each outlet opening is located proximate an edge of the recess in order to provide a smooth flow path for the air circulated by the fan. To minimize the influence of the circulating air on the operation of the gas heating element, and thereby minimizing the production of carbon monoxide, a first of the outlet openings is located at a position 45 degrees above horizontal.

13 Claims, 6 Drawing Sheets

CONVECTION OVEN

BACKGROUND OF THE INVENTION

This invention relates generally to ovens, and more particularly to convection ovens having a fan for circulating hot air throughout the cooking chamber of the oven, and specifically to a gas heated convection oven having improved cooking characteristics and lower production of carbon monoxide.

Convection cooking ovens are well known in the art. The term convection oven is used to describe anr oven having a mearis for circulating heated air within the cooking chamber ofthe oven. Air circulation within the cooking chamber results in a more even temperature distribution within the oven. Furthermore, the improved transfer of heat into the food item resulting from the hot air circulation results in a reduction in the time required to cook food items inra convection oven when compared to a standard oven operatingat the same temperature.

Convection ovens have proven to be more effective for roasting than for baking. The term roasting is generally understood to refer to browning or parching by exposing to heat, and is generally used in connection with the cooking of heavy foods such as meat. Baking, on the other hand, is generally understood to mean drying or hardening by subjecting to heat, and is generally used in connection with cooking lighter flour-based foods such as breads, cakes, pastries and cookies. A typical temperature range for roasting may be 300–350 degrees Fahrenheit, while a typical baking temperature may be 300–400 degrees Fahrenheit.

It is know that baked goods do not react well to the speedier cooking process of a convection oven. Although even heat distribution throughout an oven is a desirable feature for all types of cooking, prior art convection ovens having even heat distributions have proven to be less than optimal for baking.

Furthermore, modem gas ovens must be designed to miriimize the production of carbon monoxide (CO) during the gas combustion process. Most current production gas-heated convection ovens can not meet a requirement for maintaining CO levels within the oven to less than 800 ppm. Electric ovens do not produce carbon monoxide, but they are not preferred in many applications because of their slower heating times and higher cost of operation.

Carbon monoxide levels in a gas oven typically spike to a very high level when the gas burner is first ignited due to the fact that all of the oven surfaces are cold. As the oven heats to its operating temperature, the CO levels-are gradually reduced to their steady state levels. It is known that the operation of the fan in a convection oven will increase the amount ofcarbon monoxide produced. Therefore, the operation of the fan is delayed in some gas oven designs until several minutes after first ignition in order to avoid a further increase in the initial CO level spike. Nonetheless, peration of a convection oven fan will result in an increase in the undesirable generation of carbon monoxide in a prior art gas convection oven.

BRIEF SUMMARY OF THE INVENTION

Thus there is a need for an oven that provides the speed of cooking of a convection oven without the disadvantages of poor, baking properties. While such an oven would preferably be gas fired, there is a need to avoid the high carbon monoxide production levels normally associated with gas fired convection ovens.

Disclosed herein is an oven having a cooking chamber; a fan for circulating heated air within the cooking chamber; and a user selectable switch connected to the fan and operable to vary the speed of operation of the fan. The fan may be operable at a first speed and at a second speed faster than the first speed, and the user selectable switch may have a first position for baking wherein the fan is operated at the first speed, and a second position for roasting wherein the fan is operated at the second speed.

The oven disclosed herein may further have the fan disposed within a recess formed in a wall of the cooking chamber; and a cover plate attached to the wall and covering the fan to define a fan chamber; the cover plate further having a plurality of openings proximate a central portion of the cover plate for the passage of the heated air from the cooking chamber into the fan chamber, and three openings disposed proximate a periphery of the cover plate for the passage of heated air from the fan chamber into the cooking chamber. The three openings may each have a generally elliptical shape and may each be positioned to have an edge located adjacent an edge of the recess in order to provide a smooth flow path for the heated air passing into the cooking chamber. The three openings may be spaced equidistant around the perimeter of the cover plate, wherein a first of the three openings is centered along an imaginary line located at a forty five degree angle above horizontal.

BRIEF DESCRIPTION OF THE DRAWINGS

The features and advantages of the present invention will become apparent from the following detailed desciption of the invention when read with the accompanying drawings in which.

DETAILED DESCRIPTION OF THE INVENTION

Figure 1:
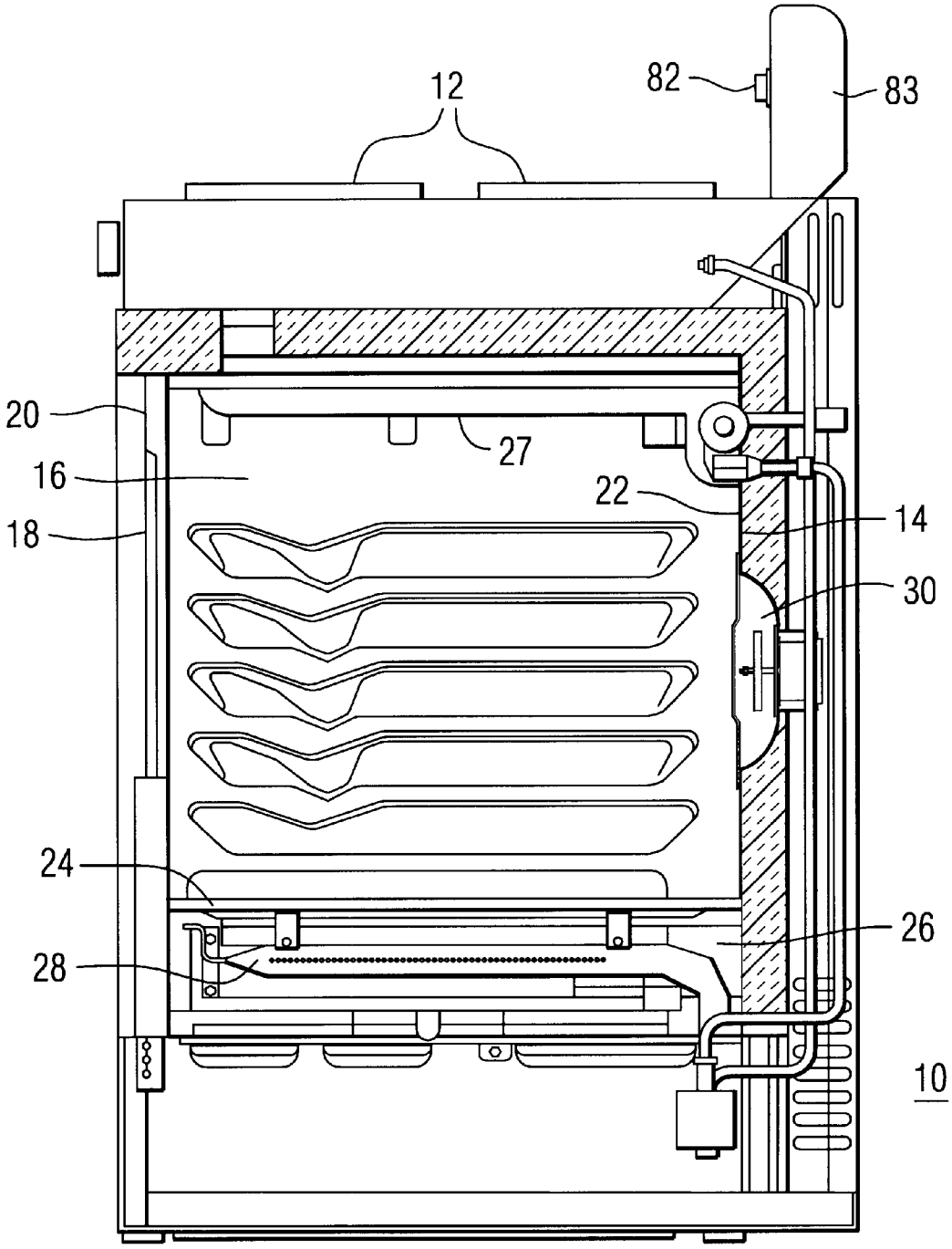
FIG. 1 is a side sectional view of a gas range including a gas-heated oven.

FIG. 1 is a side sectional view of a gas range 10 as may be typically used in a home kitchen. The range 10 includes a plurality of burners 12 for stovetop cooking and an oven 14 for baking and roasting. The oven 14 includes a cooking chamber 16 having a front wall 20 including a hinged door 18, and having a rear wall 22. An upper heating element 27, such as a burner for natural or bottled gas, may be provided within the cooking chamber 16. The oven 14 also includes floor 24 separating the cooking chamber 16 from a heating chamber 26 containing a lower radiant heating element 28 such as a burner for natural or bottled gas. The floor 24 includes a plurality of openings (not shown) for the passage of heated air from the heating chamber 26 into the cooking chamber 16.

Figure 2:
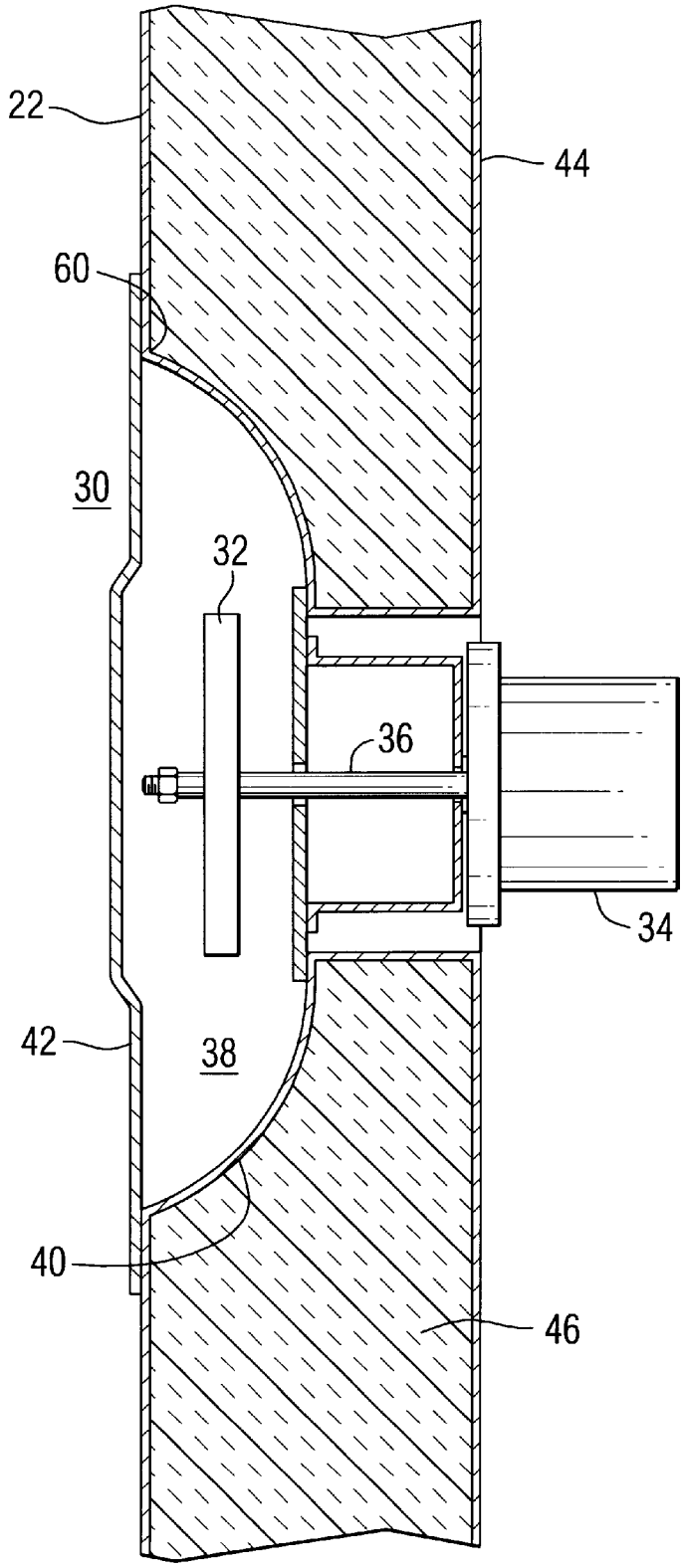
FIG. 2 is a side sectional view of the fan assembly of the gas range of FIG. 1.

Oven 14 may be operated in a convection mode, and accordingly, it is provided with a fan assembly 30 attached to rear wall 22, as may be seen more clearly in FIG. 2 As shown in that figure, fan assembly 30 includes a fan 32, in this embodiment haying propeller blade design, driven by an electric motor 34 via shaft 36. Fan 32 is disposed within a fan chamber 38. The fan chamber 38 is the space defined by recess 40 formed in back wall 22 and cover plate 42 attached to the back wall 22 over the recess 40. The space between the back wall 22 and the range back 44 may advantageously be filled with a thermal insulating material 46.

Figure 3:
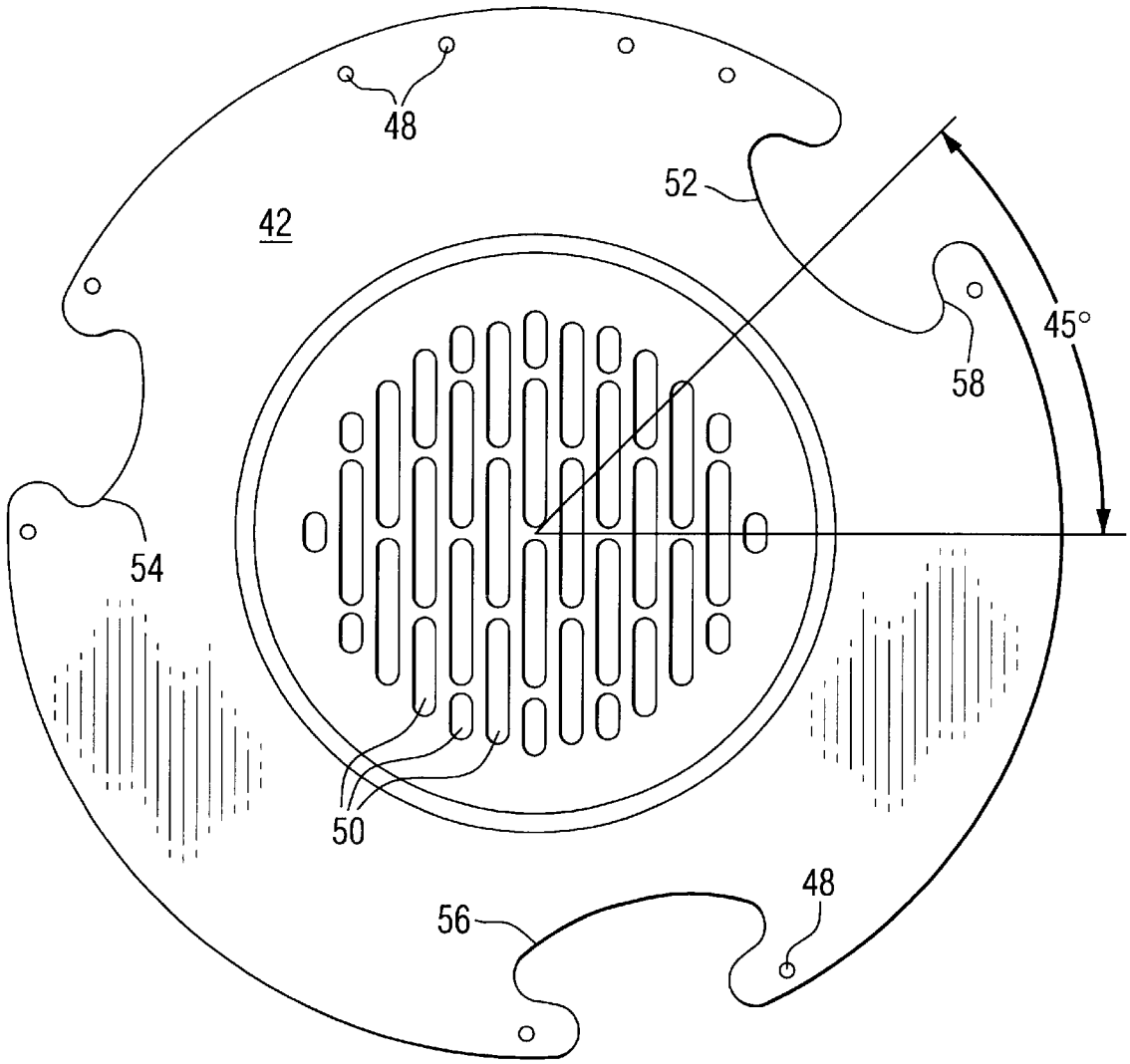
FIG. 3 illustrates the fan cover of the fan assembly of FIG. 2.

FIG. 3 is an illustration of one embodiment of cover plate 42. The cover plate 42 is sized to fit over recess 40 and to attach to back wall 22 by screws or other fasteners (not shown) inserted through holes 48. Cover plate 42 includes at least one opening 50 proximate a central portion of the plate 42 for the passage of heated air from the cooking chamber 16 into the fan chamber 38. Cover plate 42 also includes three openings 52,54,56 disposed proximate a periphery of the plate 42 for the passage of heated air from the fan chamber into the cooking chamber 16. Advantageously, the openings 52,54,56 have a generally elliptical shape or other shape avoiding shape edges. Each of the openings 52,54,56 is positioned to have an edge 58 located adjacent an edge 60 of fan recess 38 in order to provide a smooth flow path for the heated air passing into the cooking chamber 16. The smooth flow path within and exiting the fan chamber 38 eliminates turbulence and ensures optimal operation of fan 32.

Figure 4B:
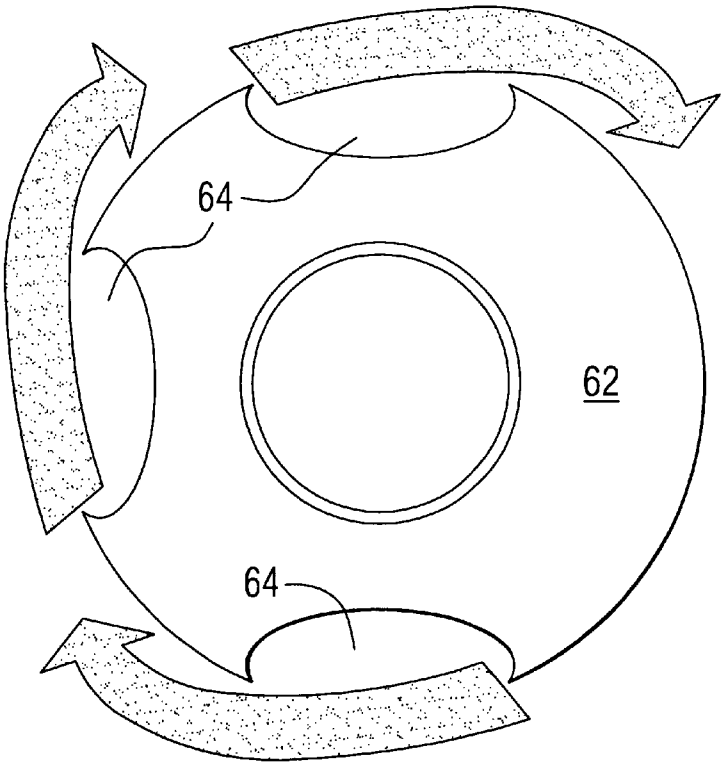
FIGS. 4A and 4B illustrate the flow of hot air exiting a fan cover disposed in two alternative positions.
Figure 4A:
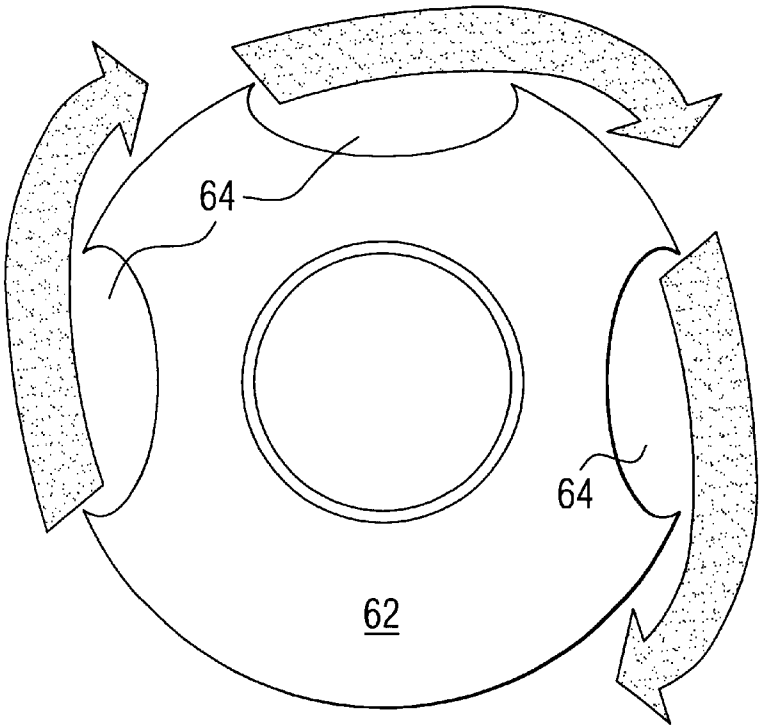

The applicants have found that the number, size, and placement of the openings in the fan cover plate will have an effect on not only the uniformity of the temperature within the cooking chamber 16 , but also on the concentration of carbon monoxide therein. FIGS. 4A and 4B illustrate a cover plate 62 having three outlet openings 64, with the two figures illustrating two possible angular positions for the installation of the plate 62. The view of these figures is as seen looking into the oven 14 through an open door 18. As may be seen by the direction of the arrows shown in the figures, the hot air flowing out of the openings 64 tends to be tangential to the perimeter of the covert plate 62 as a result of the rotational motion of fan 32. As a result, the plate position shown in FIG. 4A results in an air stream being directed toward the floor 24 of the oven 14. The applicants have found that such an air stream within the cooking chamber 16 will disturb the flow of heated air from the heating chamber 26 into the cooking chamber 16, and such interference will create instabilities in the gas flame produced by heating element 28, thereby increasing the production of carbon monoxide. The position shown in FIG. 4B avoids this problem and results in a reduction in the CO level within cooking chamber 16.

Figure 5:
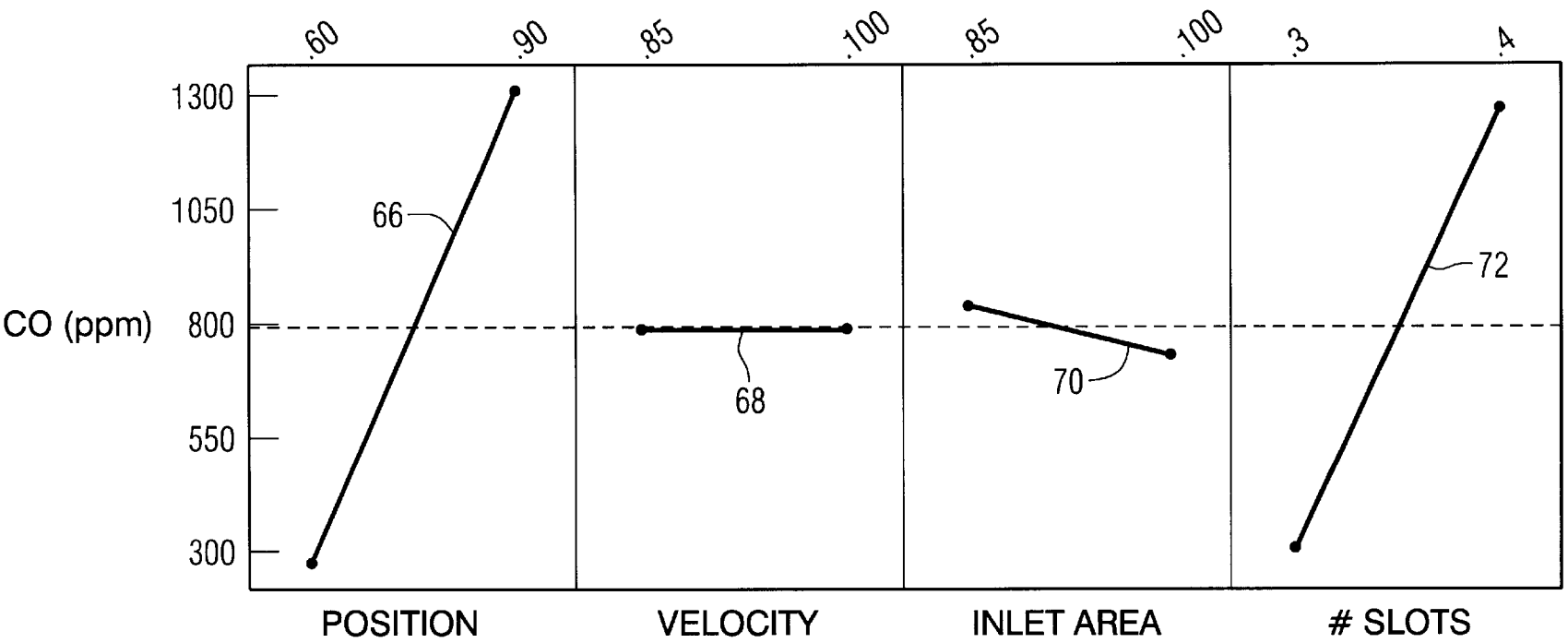
FIG. 5 illustrates the relative affect of changes in cover position, fan/air velocity, cover inlet area and number of cover openings on the level of carbon monoxide in an oven.

FIG. 5 illustrates the results of tests performed by the applicants to quantify the impact of several variables in oven design on the level of carbon monoxide in the cooking chamber 28. The vertical axis of FIG. 5 indicates the concentration (ppm) of carbon monoxide present in the cooking chamber 16 after ten minutes of operation of the heating element 28. Curves 66,68,70,72 illustrate the relative impact of fan cover outlet opening position, fan/air velocity, area of inlet openings 50, and number of outlet openings 64, respectively. Each test was performed with a cover plate having four elliptical openings located at 90-degree intervals around the perimeter of the plate. The position test indicated as 90 refers to having one of the openings centered at an angle of 90 degrees from a horizontal reference line; i.e. having the openings located at 12, 3, 6, and 9 o'clock on an imaginary clock face as viewed looking into the oven from the door opening. The position test indicated as 60 degrees refers to having one of the openings centered at an angle of 60 degrees from a horizontal reference line. The velocity tests were at 100% fan speed (1280 rpm) and 85% fan speed. The suction area tests utilized cover plates having inlet openings with a total area of 100% of the outlet area and 85% of the outlet area respectively. The test indicated as 3 slots refers to blocking one of the four outlet openings. As indicated by FIG. 5, the most important variables affecting CO production are the position and number of the outlet openings, with the 60 degree position and three openings being preferred. Additional testing performed by the applicants has shown that the embodiment of the fan cover plate 42 illustrated in FIG. 3 is a preferred embodiment. That embodiment has three openings 52,54,56 spaced equidistant around the perimeter of the cover plate 42, wherein a first 52 of the openings is centered along an imaginary line located at a forty five degree angle above horizontal.

Figure 6:
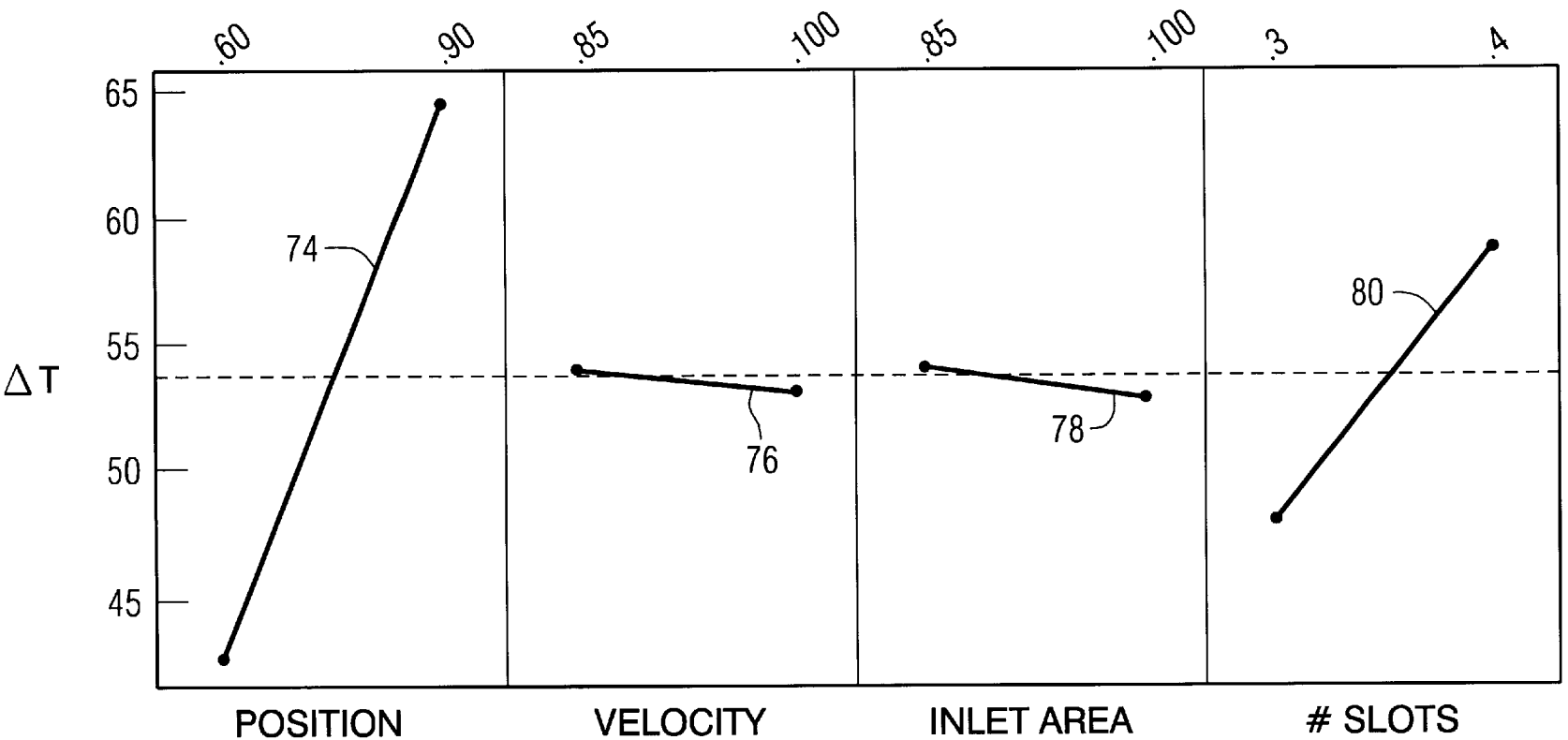
FIG. 6 illustrates the relative affect of changes in cover position, fan/air velocity, cover inlet area and number of cover openings on the temperature distribution within an oven.

The variables illustrated in FIG. 5 also have an impact on the temperature distribution within the cooking chamber 16. FIG. 6 illustrates the relative importance of these variables on this paramneter. The vertical axis in FIG. 6 indicates the temperature difference measured across multiple positions within the oven 14, therefore, a lower number is preferable. Here. again, the position and number of the outlet openings 52,54,56 are the more significant variables, and again further testing by the applicants have identified the design of FIG. 3 to be preferred. It should be noted that in order to further minimize the temperature difference in the cooking chamber 16, a second 54 of the three openings was made smaller than the first 52, and that the third 56 of the openings was made the same size as the first 52. A preferred cross-sectional area of opening 54 is approximately 50% of the cross-sectional area of opening 52. In one embodiment, thearea of openings 54 and 56 are each approximately 7.85 square inches and the area of opening 52 is approxirmately 14.3 square inches.

The data illustrated in FIGS. 5 and 6 shows that the important parameters of CO level and temperature distribution are relatively independent of the velocity of the heated air within the range of the variables tested. The applicants have used this relationship to address the issue of degraded baking performance in a convection oven. Range 10 of FIG. 1 includes a user selectable switch 82 electrically connected to fan assembly 30 and operable to vary the speed of operation of fan 32. The switch 82 may be located on the control panel or backsplash 83 of the range, or at any other location convenient for the user of the range 10. In one embodiment, the switch has a first position for baking wherein the fan is operated at a first speed correlating to a free motor speed of approximately 1,000 rpm, and a second position for roasting wherein the fan is operated at a second speed faster than the first speed and correlating to a free motor speed of approximately 1,350 rpm. The applicants have found that the performance of a convection oven may be improved by operating the fan 32 at a plurality of speeds while providing heat via the lower heating element 28. In the embodiment of a two-speed fan 32, a first slower fan speed is provided in order to provide some air circulation within the cookihg chamber 16 in order to improve the temperature distribution within the cooking chamber 16, however, the fan speed is maintained sufficiently low so as not to adversely affect the baking characteristics of the oven when it is used to cook pastries, cookies, etc. A second faster fan speed is also provided in order to further improve the roasting performance of the oven when it is used to cook meats. The operator of the oven maybe provided with instructions for selecting from among the plurality of available speeds depending upon the food to be cooked in the oven 14. The interconnection between switch 82 and fan assembly 30 may be any form known in the art. One embodiment may include a two speed fan and a three position switch including one position to de-energize the fan for operating the oven as a conventional oven without convection. Conventional heating of the oven 10 can be accomplished by using the upper heating element 27 for broiling or the lower heating element 28 for baking without operating fan assembly 30. Instructions may be provided to a user for selecting from among a plurality of speed depending upon the food to be cooked. An alternative embodiment may include a listing of foods being presented to the operator for selection, such as via a touch-screen menu display device included in range 10, with an electronic control system automatically selecting an appropriate fan speed for that type of food item.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An oven comprising:

a cooking chamber comprising a wall having a protrusion formed therein defining a fan chamber;

a fan disposed within the fan chamber;

a cover attached to the wall over the chamber. the cover comprising an opening proximate a central portion of the cover for the passage of heated air from the cooking chamber into the fan chamber, and a plurality of three openings disposed proximate a periphery of the cover for directing the passage of heated air from the fan chamber into the cooking chamber along a selected direction;

wherein each of the three openings is spaced equidistant from any adjacent openings around the perimeter of the plate, and wherein a first of the three openings is centered along an imaginary line located at a forty five degree angle above horizontal.

2. The oven of claim 1, wherein the three openings each have a generally elliptical shape and are each positioned to have an edge located adjacent an edge of the fan chamber in order to provide a smooth flow path for the heated air passing into the cooking chamber.

3. The oven of claim 1, wherein a second of the three openings is smaller than the first, and a third of the three openings is the same size as the first.

4. The oven of claim 1, further comprising a user selectable switch connected to the fan and operable to vary the speed of the heated air within the cooking chamber.

5. The oven of claim 1, wherein the fan is operable at a first speed and at a second speed faster than the first speed; and further comprising a user selectable switch connected to the fan and having a first position for operating the fan at the first speed for baking and a second position for operating the fan at the second speed for roasting.

6. An oven comprising:

a cooking chamber;

a fan for circulating heated air within the cooking chamber;

a user selectable switch connected to the fan and operable to vary the speed of the heated air within the cooking chamber, wherein the fan is disposed within a recess formed in a wall of the cooking chamber;

a cover plate attached to the wall and covering the fan to define a fan chamber, the cover plate further comprising at least one opening proximate a central portion of the cover plate for the passage of the heated air from the cooking chamber into the fan chamber, and a plurality of three openings disposed proximate a periphery of the cover plate for directing the passage of heated air from the fan chamber into the cooking chamber along a selected direction, wherein each of the three openings is spaced equidistant from any adjacent openings around the perineter of the cover plate, and wherein a first of the three openings is centered along an imaginary line located at a forty five degree angle above horizontal.

7. An oven comprising:

a cooking chamber;

a fan for circulating heated air within the cooking chamber;

a user selectable switch connected to the fan and operable to vary the speed of the heated air within the cooking chamber, wherein the fan is disposed within a recess formed in a wall of the cooking chamber;

a cover plate attached to the wall and covering the fan to define a fan chamber, the cover plate further comprising at least one opening proximate a central portion of the cover plate for the passage of the heated air from the cooking chamber into the fan chamber, and a plurality of three openings disposed proximate a periphery of the cover plate for directing the passage of heated air from the fan chamber into the cooking chamber along a selected direction, wherein each of the three openings is spaced equidistant from any adjacent openings around the perimeter of the cover plate, and wherein a first of the openings is centered along an imaginary line located at a forty five degree angle above horizontal, wherein the three openings each have a generally elliptical shape and are each positioned to have an edge located adjacent an edge of the recess in order to provide a smooth flow path for the heated air passing into the cooking chamber.

8. An oven comprising:

a cooking chamber;

a fan for circulating heated air within the cooking chamber;

a user selectable switch connected to the fan and operable to vary the speed of the heated air within the cooking chamber, wherein the fan is disposed within a recess formed in a wall of the cooking chamber;

a cover plate attached to the wall and covering the fan to define a fan chamber, the cover plate further comprising at least one opening proximate a central portion of the cover plate for the passage of the heated air from the cooking chamber into the fan chamber, and a plurality of three openings disposed proximate a periphery of the cover plate for directing the passage of heated air from the fan chamber into the cooking chamber along a selected direction, wherein each of the three openings is spaced equidistant from any adjacent openings around the perimeter of the cover plate, and wherein a first of the three openings is centered along an imaginary line located at a forty five degree angle above horizontal, wherein the three openings each have a generally elliptical shape and are each positioned to have an edge located adjacent an edge of the recess in order to provide a smooth flow path for the heated air passing into the cooking chamber, wherein a second of the three openings is smaller than the first, and a third. of the three openings is the same size as the first.

9. A method of cooking comprising:

providing a convection oven having a cooking chamber and having a fan operable at a plurality of speeds for circulating heated air within the cooking chamber at a corresponding plurality of velocities;

providing a user selectable switch operable to select the speed of operation of the fan from among the plurality of velocities;

providing a recess in a wall of the cooking chamber;

disposing the fan within the recess;

attaching a cover plate to the wall over the fan to define a fan recess;

providing at least one opening proximate a central portion of the cover plate for the passage of the heated air from the cooking chamber into the fan chamber;

providing a plurality of three openings, the plurality of three openings disposed proximate a periphery of the cover plate for directing the passage of heated air from the fan chamber into the cooking chamber along a selected direction;

spacing each of the three openings equidistant from any adjacent openings around the perimeter of the cover plate; and centering a first of the three openings along an imaginary line located at a forty five degree angle above horizontal.

10. A method of cooking comprising:

providing a convection oven having a cooking chamber and having a fan operable at a plurality of speeds for circulating heated air within the cooking chamber at a corresponding plurality of velocities;

providing a user selectable switch operable to select the speed of operation of the fan from among the plurality of velocities;

providing a recess in a wall of the cooking chamber;

disposing the fan within the recess;

attaching a cover plate to the wall over the fan to define a fan recess;

providing at least one opening proximate a central portion of the cover plate for the passage of the heated air from the cooking chamber into the fan chamber:

providing a plurality of three openings, the plurality of three openings disposed proximate a periphery of the cover plate for directing the passage of heated air from the fan chamber into the cooking chamber along a selected direction;

spacing each of the three openings equidistant from any adjacent openings around the perimeter of the cover plate;

centering a first of the three openings along an imaginary line located at a forty five degree angle above horizontal;

providing the three openings each with a generally elliptical shape; and positioning each of the three openings to have an edge located adjacent an edge of the recess in order to provide a smooth flow path for the heated air passing into the cooking chamber.

11. A method of cooking comprising:

providing a convection oven having a cooking chamber and having a fan operable at a plurality of speeds for circulating heated air within the cooking chamber at a corresponding plurality of velocities;

providing a user selectable switch operable to select the speed of operation of the fan from among the plurality of velocities;

providing a recess in a wall of the cooking chamber;

disposing the fan within the recess;

attaching a cover plate to the wall over the fan to define a fan recess;

providing at least one opening proximate a central portion of the cover plate for the passage of the heated air from the cooking chamber into the fan chamber;

providing a plurality of three openings, the plurality of three openings disposed proximate a periphery of the cover plate for directing the passage of heated air from the fan chamber into the cooking chamber along a selected direction;

spacing each of the three openings equidistant from any adjacent openings around the perimeter of the cover plate;

centering a first of the three openings along an imaginary line located at a forty five degree angle above horizontal;

providing the three openings each with a generally elliptical shape;

positioning each of the three openings to have an edge located adjacent an edge of the recess in order to provide a smooth flow path for the heated air passing into the cooking chamber;

forming a second of the three openings to be smaller than the first; and forming a third of the three openings to be the same size as the first.

12. An oven comprising:

a cooking chamber;

a fan for circulating heated air within the cooking chamber, the fan disposed within a recess formed in a wall of the cooking chamber;

a cover plate attached to the wall and covering the fan to define a fan chamber, the cover plate further comprising a plurality of openings proximate a central portion of the cover plate for the passage of the heated air from the cooking chamber into the fan chamber, and three openings disposed proximate a periphery of the cover plate for the passage of heated air from the fan chamber into the cooking chamber, wherein the three openings are spaced equidistant around the perimeter of the cover plate, and a first of the three openings is centered along an imaginary line located at a forty five degree angle above horizontal, and further wherein a second of the three openings is smaller than the first, and a third of the three openings is the same size as the first; and a user selectable switch connected to the fan and operable to vary the speed of operation of the fan.

13. A method of cooking comprising:

providing a convection oven having a cooking chamber;

providing a recess in a wall of the cooking chamber;

disposing a fan within the recess, the fan operable at a plurality of speeds for circulating heated air within the cooking chamber at a corresponding plurality of velocities;

attaching a cover plate to the wall over the fan to define a fan recess;

providing a plurality of openings proximate a central portion of the cover plate for the passage of the heated air from the cooking chamber into the fan chamber;

providing three openings disposed proximate a periphery of the cover plate for the passage of heated air from the fan chamber into the cooking chamber;

spacing the three openings equidistant around the perimeter of the cover plate, centering a first of the three openings along an imaginary line located at a forty five degree angle above horizontal;

forming a second of the three openings to be smaller than the first;

forming a third of the three openings to be the same size as the first; and providing a user selectable switch operable to select the speed of operation of the fan from among the plurality of velocities.

* * * * *

UNITED STATES PATENT AND TRADEMARK OFFICE

CERTIFICATE OF CORRECTION

PATENT NO. : 6,615,819 B1 
DATED : September 9, 2003
INVENTOR(S) : Jose Hernandez Burgos et al.

It is certified that error appears in the above-identified patent and that said Letters Patent is hereby corrected as shown below:

Column 6,
Line 13, delete “perineter” insert therefor -- perimeter --.

Column 7,
Line 3, delete “a third. of the” insert therefor -- a third of the --.

Signed and Sealed this

Eighteenth Day of November, 2003

JAMES E. ROGAN
*Director of the United States Patent and Trademark Office*